US005875543A

United States Patent [19]

Fujimoto et al.

[11] Patent Number: 5,875,543

[45] **Date of Patent: *Mar. 2, 1999**

[54] COIL TYPE NOISE SUPPRESSING HIGH VOLTAGE RESISTANT WIRE

[75] Inventors: Terutsugu Fujimoto; Makoto Higashikozono; Hiroshi Inoue, all of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 799,541

[22] Filed: Feb. 13, 1997

Related U.S. Application Data

[63] Continuation of Ser. No. 516,391, Aug. 17, 1995, abandoned.

[30] Foreign Application Priority Data

Sep. 1, 1994 [JP] Japan ..... 6-208922

[51] Int. Cl.[6] ..... H01C 17/04

[52] U.S. Cl. ..... 29/618; 29/610.1; 338/270; 338/214; 338/66; 174/102 SC

[58] Field of Search ..... 29/618, 828, 610.1; 338/270, 214, 66; 174/102 SC, 120 SC

[56] References Cited

U.S. PATENT DOCUMENTS

| | | | |
|---|---|---|---|
| 3,573,230 | 3/1971 | Voorhees | 252/514 |
| 3,870,987 | 3/1975 | Wiley et al. | 338/214 |
| 4,412,938 | 11/1983 | Kakizaki et al. | 252/511 |
| 4,435,692 | 3/1984 | Miyamoto et al. | 338/214 |
| 4,493,787 | 1/1985 | Taniguchi et al. | 174/102 SC |
| 4,700,171 | 10/1987 | Coffey et al. | 338/214 |
| 4,748,436 | 5/1988 | Kanamori et al. | 338/214 |
| 4,818,438 | 4/1989 | Wiley | 338/66 |
| 4,857,232 | 8/1989 | Burns, Jr. | 252/511 |
| 4,894,490 | 1/1990 | Fujimoto | 338/214 |
| 4,970,488 | 11/1990 | Horiike et al. | 338/214 |
| 5,057,812 | 10/1991 | Yukawa et al. | 338/66 |

*Primary Examiner*—Michael L. Gellner
*Assistant Examiner*—Karl Easthom
*Attorney, Agent, or Firm*—Jordan B. Bierman; Bierman, Muserlian and Lucas

[57] ABSTRACT

A coil type, noise suppressing high voltage resistor wherein, without applying a releasing agent to the coil core, the adhesiveness of the fluorocarbon polymer in its unvulcanized state is reduced sufficiently so that unwinding of the unvulcanized core, followed by winding of the resistance wire, can be smoothly carried out. On the coil core covered by extrusion coating with a fluorocarbon polymer mixed with ferrite powder, the resistance wire is helically wound. The coil core to which the resistance wire has been applied is then covered in sequence with an insulating layer, a braid for reinforcement, and a sheath. The fluorocarbon polymer is a blend polymer mixture including a reinforcing polymer, preferably an ethylene-vinyl acetate copolymer, which is compatible with the fluorocarbon polymer and can be co-vulcanized therewith. The blend ratio is 5% to 25% by weight of the EVA, based on the total mixture.

15 Claims, 1 Drawing Sheet

COIL TYPE NOISE SUPPRESSING HIGH VOLTAGE RESISTANT WIRE

This application is a continuation of application Ser. No. 08/516,391, filed Aug. 17, 1995, now abandoned.

This Application claims the benefit of the priority of Japanese Application 6-208922, filed Sep. 1, 1994.

The present Invention relates to a coil type, noise suppressing, high voltage resistor to be used (for example) as an ignition cable for an internal combustion engine.

BACKGROUND OF THE INVENTION

A resistance wire for transmitting high voltage generated in an ignition coil through a distributor, or directly to a spark plug, is required to have small transmission loss, excellent noise suppression, and excellent heat and voltage resistance. At present, there are generally used (1) cord type high voltage resistance wires made by impregnating carbon in a fiber and (2) coil type high voltage resistance wires made by winding a fine metal wire, having a high inherent resistance, on a core such as a magnetic material.

As the aforedescribed coil type high voltage resistance wire, there is known, as shown in FIG. 2, a product wherein coating coil core 52 is extruded from a fluorocarbon polymer containing ferrite powder onto a filament such as an aromatic polyamide (aramid) or glass fiber. Resistance wire 53 is helically wound around core 52 and embedded therein. Insulating layer 54 is extrusion coated on both core 52 and wire 53, and braid 55 is coated thereon. Finally, sheath 56 covers braid 55 (see Japanese Utility Model Publication No. 32253/1989). When resistance wire 53 is wound around and embedded in coil core 52, it should not slide on core 52, nor should there be any damage to wire 53 resulting from bending or impact when the end portion is connected to the terminal fitting.

In manufacturing the above coil type high voltage resistance wire, the general practice is to extrusion coat ferrite mixed with fluorocarbon polymer on reinforced cord 51 and cool the resultant product to form coil core 52; thereafter, coil core 52 is wound onto a bobbin. Resistance wire 53 is wound around core 52 while it is being unreeled from the bobbin.

Since it is of importance that resistance wire 53 be embedded in coil core 52 when it is wound therearound, it is necessary that the fluorocarbon polymer be unvulcanized in order to permit this. In normal manufacturing procedure, the unvulcanized coil core, prior to the application of resistance wire 53, is often stored for a substantial period of time on the bobbin. Because of the lack of vulcanization, the adhesive strength is high and the coils have a strong tendency to stick together. As a result, unwinding coil core 52 from the bobbin is difficult and sometimes impossible.

In order to overcome this problem, the prior art has coated the surface of coil core 52 with a releasing agent, such as talc, silicon oil, or the like. This is not entirely satisfactory, since it makes the surface of coil core 52 excessively slippery, which interferes with the embedding of resistance wire 53 into coil wire 52. In addition, it impairs the ability to put tension on the wire while the resistance wire is being wound therearound.

SUMMARY OF THE INVENTION

Thus, it is an object of the present Invention to provide a high voltage resistor of the type disclosed wherein winding of the resistance wire around its core can be smoothly carried out and, at the same time, the adhesive strength of the core is such that, even when wound on bobbins for a long period of time, the coils do not stick to one another.

It has been found that, by appropriately limiting the composition of the fluorocarbon polymer coil core, the high voltage resistor of the present Invention can be formed without the foregoing problems. Specifically, 100 parts by weight of a polymer blend comprises between 5 parts and 25 parts by weight of a reinforcing polymer, the remainder being fluorocarbon polymer. To this blend, ferrite is added. The reinforcement polymer should have good compatibility with the fluorocarbon polymer and be capable of vulcanization therewith. In particular, ethylene/vinyl acetate copolymers or a chlorinated polyethylenes are suitable. Thus, before vulcanization, the components are compatible with each other and can be mixed readily due to their improved strength and low viscosity. After co-vulcanization, it has been found surprisingly that no appreciable loss in physical properties occurs.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
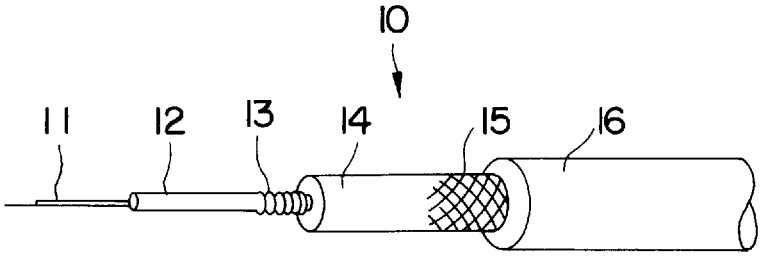
FIG. 1 is a perspective view of the coil type, noise-suppressing, high voltage resistor in accordance with the present Invention.
Figure 2:
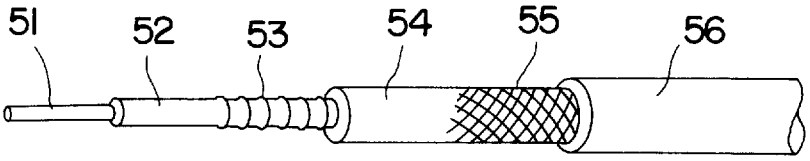
FIG. 2 PRIOR ART
FIG. 2 is a perspective view, similar to that of FIG. 1, in accordance with the prior art.

As can be seen in FIG. 1, coil type, noise-suppressing high voltage resistor 10 comprises reinforced core 11 surrounded by coil core 12 having resistance wire 13 wrapped therearound and embedded therein. Insulation 14 covers resistance wire 13 and braid 15 reinforces insulation 14. Overall is sheath 16.

Reinforced core 11 is preferably of 3 plies of 1000 denier aramid yarn. Coil core 12 comprises a mixture of 100 parts by weight of the fluorocarbon polymer blend, which comprises 5 to 25 parts by weight of the reinforcement polymer and 95 to 75 parts by weight of the fluorocarbon polymer, with about 400 parts by weight of ferrite. The reinforcement polymer advantageously is ethylene/vinyl acetate (EVA) copolymer or chloropolyethylene, the former being preferred.

Wire 13 is of nickel/chromium alloy, with a diameter of 50 microns, has a resistance of approximately 550 ohms/meter. Advantageously, 7200 coils per meter of resistance wire 13 are wound around and embedded in unvulcanized coil core 12. Insulation layer 14, preferably of ethylene/propylenediene copolymer (EPDM), is extrusion coated onto core 12 and resistance wire 13. It has advantageously an outer diameter of 4.6 mm. Reinforcing braid 15 is applied to the outer surface of insulation layer 14 and is desirably of glass yarn. Finally, sheath 18, also usefully of EPDM, is coated onto braid 15 to a preferred outer diameter of 7.0 mm. As previously indicated, in place of EVA, chlorinated polyethylene has been found suitable.

EXAMPLES

Examples A to F were prepared. In the following description, all parts and/or percentages are by weight. 100 parts of fluorocarbon polymer blend were blended with 400 parts of ferrite powder, 2 parts sodium stearate (as a processing aid), 5 parts of a polyfunctional crosslinking auxiliary such as the allyl isocyanate (TAIC from Nippon Kasei), as vulcanizer 1, and 1 part organic peroxide, such as 1, 3 bis(t-butylperoxy isopropyl)benzene (Percadox 14), as vulcanizer 2. In addition, in Examples B through F, varying amounts of EVA were included in the mix. The compositions of the various Examples, along with their various characteristics are set forth in Table 1 herein. The Mooney viscosities were determined in accordance with JIS K 6300, while the tensile strengths and elongations were determined in accordance with JIS K 6301.

TABLE 1

| Test object | | A | B | C | D | E | F | |
|---|---|---|---|---|---|---|---|---|
| Components | | | | | | | | |
| Fluororubber parts by weight | | 100 | 95 | 90 | 80 | 75 | 70 | |
| E V A parts by weight | | — | 5 | 10 | 20 | 25 | 30 | |
| Ferrite parts by weight | | 400 | 400 | 400 | 400 | 400 | 400 | |
| Processing auxiliary parts by weight | | 2 | 2 | 2 | 2 | 2 | 2 | |
| Vulcanizer 1 parts by weight | | 5 | 5 | 5 | 5 | 5 | 5 | |
| Vulcanizer 2 parts by weight | | 1 | 1 | 1 | 1 | 1 | 1 | Spec. |
| Physical properties | | | | | | | | |
| Mooney viscosity ML1 + 4 (100° C.) | | 140 | 140 | 140 | 110 | 100 | 90 | ≦200 |
| Un- | Tensile strength (MPa) | 1.1 | 1.1 | 1.2 | 1.4 | 1.5 | 1.6 | ≧1 |
| vulc- | Elongation (%) | 70 | 75 | 80 | 70 | 60 | 50 | ≧60 |
| anized | Adhesive strength (kgf/cm) | * | 1.0 | 0.4 | 0 | 0 | 0 | ≧3 |
| Vulc- | Tensile strength (MPa) | 3.0 | 3.0 | 3.0 | 3.2 | 3.2 | 3.3 | ≧3 |
| anized | Elongation (%) | 250 | 250 | 240 | 190 | 170 | 140 | ≧100 |
| Roll processing property | | ○ | ○ | ○ | Δ | Δ | X | to be good |

*Releasing impossible

As can be seen from Table 1, Example A, having no EVA and representing the known prior art, had an adhesive strength which was so great that, in the unvulcanized condition, it could not be unwound from the reel upon which it had been stored. Thus, it was not even possible to apply the resistance wire thereto. Example F, being just beyond the claimed maximum, could easily be uncoiled from the spool, but satisfactory contact between the material and the roll could not be obtained. Therefore, it was not possible to properly blend the ferrite into the mix, nor could a satisfactory dispersion of the mixing agents be obtained.

However, when the present Invention is considered, (Examples B through E), it can be seen that there is no substantial adhesion of successive coils to each other and the mixing qualities were good to excellent. Thus, the present Invention provides high voltage resistant wires with a core material which can easily be mixed by a roll mill, and possesses sufficiently low adhesive strength so that the unvulcanized cores can be wound onto reels, stored substantial periods of time, and readily unreeled for application of the resistance wire.

While only a limited number of specific embodiments of the present Invention have been expressly described, it is, nonetheless, to be broadly construed, and not to be limited except by the character of the claims appended hereto.

What we claim is:

1. A method of making a coil type, noise suppressing, high-voltage resistant wire, said wire having a core which comprises a reinforced core, and a coil core which is formed with and surrounds said reinforced core, said method comprising surrounding said reinforced core with a coil core, said coil core comprising an unvulcanized plastic layer, winding said core around a reel, in the absence of a release agent, so that successive coils of said core abut each other, unwinding said core from said reel in the absence of a release agent, helically winding a resistance wire around said core and embedding said resistance wire at least partly in said core, applying an insulating layer around said core and said resistance wire, and vulcanizing said coil core with said resistance wire thereon, said plastic layer comprising a mixture of a fluorocarbon polymer blend and ferrite powder, said polymer blend comprising 95 to 75 parts by weight of a fluorocarbon polymer and 5 to 25 parts by weight as a second polymer, said second polymer selected from the group consisting of an ethylene/vinyl acetate copolymer and a chlorinated polyethylene, said second polymer being compatible with said fluorocarbon polymer, whereby said unwinding is carried out without substantial adhesion of said successive coils to each other.

2. The method of claim 1 wherein said reinforced core is an aramid yarn.

3. The method of claim 1 wherein said ferrite powder is present in said mixture in an amount of 400 parts by weight based on 100 parts by weight of said blend.

4. The method of claim 1 wherein said fluorocarbon polymer is a fluororubber.

5. The method of claim 1 wherein said second polymer is an ethylene/vinyl acetate copolymer.

6. The method of claim 1 wherein said mixture further comprises a vulcanizer.

7. A method for preventing adhesion between successive coils of a core on a reel, wherein said core comprises a reinforced core having a coil core which is formed with and surrounds said reinforced core, and said core is unwound from said reel to form a coil type, noise suppressing, high-voltage resistant wire, said method comprising:

forming a mixture of a fluorocarbon polymer blend and ferrite powder, said polymer blend comprising 95 to 75 parts by weight of a fluorocarbon polymer and 5 to 25 parts by weight of a second polymer, said second polymer selected from the group consisting of an ethylene/vinyl acetate copolymer and a chlorinated polyethylene, said second polymer being compatible with said fluorocarbon polymer; and surrounding said reinforced core with a coil core wherein said coil core comprises said mixture whereby adhesion between successive coils is prevented.

8. The method of claim 7 wherein said ferrite powder is present in said mixture in an amount of 400 parts by weight based on 100 parts by weight of said blend.

9. The method of claim 7 wherein said fluorocarbon polymer is a fluororubber.

10. The method of claim 7 wherein said second polymer is an ethylene/vinyl acetate copolymer.

11. The method of claim 7 wherein said mixture further comprises a vulcanizer.

12. The method of claim 7 wherein said ferrite powder is present in said mixture in an amount of 400 parts by weight based on 100 parts by weight of said blend; said fluorocarbon polymer is fluororubber; said second polymer is an ethylene/vinyl acetate copolymer; and said mixture further comprises a vulcanizer.

13. In a method for making a coil type, noise suppressing, high-voltage resistant wire wherein said wire has a core that is wound on a reel prior to formation of said wire, and said core comprises a coil core which is formed with and surrounds a reinforced core, and said coil core is made from a mixture of a fluorocarbon polymer and ferrite powder, the improvement comprising:

including in said mixture a second polymer selected from the group consisting of an ethylene/vinyl acetate copolymer and a chlorinated polyethylene, such that said mixture comprises a polymer blend of 95 to 75 parts by weight fluorocarbon polymer and 5 to 25 parts by weight said second polymer; and using said mixture with said second polymer therein to make said coil core.

14. The method of claim 13 wherein said fluorocarbon polymer is a fluororubber.

15. The method of claim 13 wherein said second polymer is an ethylene/vinyl acetate copolymer.

* * * * *